US005787937A

United States Patent [19]

Teufel

[11] Patent Number: 5,787,937

[45] Date of Patent: Aug. 4, 1998

[54] METHOD FOR MONITORING THE PROPER FUNCTIONING OF ELECTROMAGNETIC AIR VALVES IN PNEUMATIC LOOMS

[75] Inventor: Dieter Teufel, Langenargen, Germany

[73] Assignee: Lindauer Dornier Gesellschaft mbH, Lindau, Germany

[21] Appl. No.: 810,740

[22] Filed: Jan. 24, 1997

[30] Foreign Application Priority Data

Jan. 25, 1996 [DE] Germany ..... 196 02 513.3

[51] Int. Cl.[6] ..... D03D 47/30

[52] U.S. Cl. ..... 139/435.5; 73/168

[58] Field of Search ..... 73/168; 139/435.5, 139/370.2, 435.2

[56] References Cited

U.S. PATENT DOCUMENTS

| | | | |
|---|---|---|---|
| 4,020,877 | 5/1977 | Spisiak et al. | 139/435.5 |
| 4,487,235 | 12/1984 | Sugita et al. | 139/370.2 |
| 4,673,004 | 6/1987 | Rosseel et al. | 139/435.5 |
| 5,031,669 | 7/1991 | Wahhoud et al. | 139/370.2 |
| 5,031,672 | 7/1991 | Wahhoud et al. | 139/435.2 |
| 5,067,527 | 11/1991 | Le Jager | 139/435.2 |

FOREIGN PATENT DOCUMENTS

| | | | |
|---|---|---|---|
| 0494050 | 7/1992 | European Pat. Off. . | |
| 0554221 | 8/1993 | European Pat. Off. . | |
| 0415875 | 5/1994 | European Pat. Off. . | |
| 4226693 | 2/1993 | Germany . | |
| 4-352848 | 12/1992 | Japan | 139/435.2 |

*Primary Examiner*—Andy Falik
*Attorney, Agent, or Firm*—W. F. Fasse; W. G. Fasse

[57] ABSTRACT

A method for monitoring the functional reliability of magnetic valves in pneumatically operated systems of an air jet loom, such as the valves for the relay nozzles, allows the failure of such a valve to be quickly detected and corrected. The characteristic progression curve (2) of the valve actuation current (I) as a function of time (t) is monitored for each magnetic valve to detect and evaluate the occurrence, relative timing, and magnitude of a characteristic feature (3), such as a current dip (3), in the increasing portion (2*a*) of the current progression curve (2). If the characteristic feature (3) is completely missing, or deviates in time or magnitude outside of a tolerance range relative to corresponding nominal values, then a corresponding fault signal is triggered or the weaving process is interrupted. Alternatively, the time of initiating the actuation signal for the respective valve is shifted to bring the actual operation of the valve back into the acceptable tolerance range.

20 Claims, 2 Drawing Sheets

METHOD FOR MONITORING THE PROPER FUNCTIONING OF ELECTROMAGNETIC AIR VALVES IN PNEUMATIC LOOMS

PRIORITY CLAIM

This application is based on and claims the priority of the corresponding German Priority Application 196 02 513.3-26, filed on Jan. 25, 1996 in the Federal Republic of Germany.

FIELD OF THE INVENTION

The invention relates to a method for monitoring the proper functioning and reliability of electrically actuatable magnetic valves for controlling the air flow to the air jets in pneumatic looms.

BACKGROUND INFORMATION

Pneumatic or air jet looms may have one or more weft thread delivery systems, including a main insertion nozzle that initially inserts each weft thread into the respective loom shed, and a plurality of relay nozzles arranged across the width of the loom to carry the weft thread across the loom through the loom shed. In order to pneumatically drive or actuate the main nozzles and the relay nozzles, the loom control respectively includes a pressure and time regulating circuit including appropriate controls and regulation valves for the air supply to the nozzles.

Generally, the beginning and end of each weft thread insertion is detected or monitored by a weft stop motion device or a weft monitor. It is also known to arrange additional stop motion devices or weft monitors at locations between the beginning and the end of the weft thread insertion path for detecting or monitoring the flight path of the pneumatically inserted weft thread. Various per se known control and regulation arrangements have been put into use to monitor and if necessary correct the weft thread insertion flight time. These known arrangements determine the actual thread flight time and compare it to the rated or nominal thread flight time so that the insertion parameters, i.e. air jet pressure and air jet duration, can be automatically corrected or adjusted as necessary so that the actual thread flight time adequately corresponds to the rated or nominal flight time.

European Patent 0,415,875 discloses a method for adjusting the weft yarn stretch in a loom shed and a method for adjusting the air consumption of relay nozzles in air jet looms. The known method aims to reduce the consumption of compressed air by the relay nozzles to the lowest possible level without risking additional interruptions of the weaving process. In order to achieve this, the known method provides a regulating criterion for actuating the relay nozzles, whereby only the minimum required amount of pressurized air is provided to the respective nozzles in each case. More specifically, during insertion of a weft thread, a time difference $\Delta t_1$ is measured between the weft arrival signal provided by a weft detector at the outlet end of the loom shed and the stop shock or an equivalent weft end signal for the run out of the tail end of a previously measured weft yarn, which is detected by a stop detector positioned before the shed entry. This time difference $\Delta t_1$ is used as a characterizing parameter for the stretching of the weft thread in the shed and as a characterizing parameter for the effect of the relay nozzles, in the control of the loom.

It is generally known that not only the air jet pressure, but also the duration of each relay nozzle air jet period are important parameters for achieving a proper weft thread insertion. The air jet duration for the relay nozzle can be determined or controlled by appropriately controlling the duration of the electrical actuation of the magnetic control valves provided respectively for each relay nozzle or each group of relay nozzles. In the prior art, the complete failure of operation of a magnetic valve during the weaving operation cannot always be immediately detected. Moreover, a gradual deterioration or deviation in the operation of a magnetic valve has been even more difficult to detect. As a secondary effect of such failure or deterioration of the magnetic valves, the actual measured insertion time for the weft thread will be increased. However, such an increased insertion time may be due to several causes other than failure or deterioration of the operation of the magnetic valves, and also cannot indicate which particular valve is faulty.

Furthermore, it is generally known that all electromagnetic systems, and therefore also the magnetic valves and the actuation circuits therefor, comprise a characteristic current variation pattern or curve over time, i.e. a characteristic progression of the actuation current I as a function of time t. In the actuation circuit of a magnetic valve, the rising or increasing portion at the beginning of the current curve will possess a particular characteristic feature, namely a momentary break, dip, or fluctuation in the current. This current dip is regularly caused when the magnetic circuit in an electromagnetic system is closed or completed. For example, this can occur due to the mechanical shifting displacement of the armature that is used in the respective magnetic valve for controlling the air passage leading to the relay nozzles, from a first end position corresponding to a valve-closed position, to a second end position corresponding to a valve-open operating position. Namely, when the magnetic valve actually physically switches over, a small momentary dip in the energizing current results.

As described above, the method according to European Patent 0,415,875 uses a time difference $\Delta t_1$ basically between the weft arrival at the outlet end of the shed and the weft tail run out at the entry of the shed, as a parameter for evaluating the degree of weft stretch and accordingly adjusting the operation of the relay nozzles in the control of the loom. However, the European Patent does not discuss valve failures and the like as causes that bring about such a time difference value $\Delta t_1$, and does not disclose means of avoiding or removing such causes. Moreover, the very specific and relatively short time durations relating to the above described current dips caused by the actual physical switching over of the magnetic valves are not taken into account.

OBJECTS OF THE INVENTION

In view of the above it is the aim of the invention to achieve one or more of the following objects singly or in combination:

- to improve the functional reliability of magnetic valves in weaving looms, so as to improve the reliability of the air jet weft insertion system and other auxiliary systems equipped with magnetic valves in a loom, for example pneumatically driven selvage laying-in devices;
- to detect the complete failure in the operation of a magnetic valve substantially immediately during the weaving process;
- to detect the deterioration or operational deviation of a magnetic valve from its intended operation, substantially immediately during the weaving process;
- to enable individual magnetic valves and groups of valves to be adjusted in the timing of their air jet delivery, to ensure that the actual timing and duration of a given air jet adequately matches the nominal desired parameters for that air jet;

to fine-tune the operation of the magnetic valves controlling the air for the relay nozzles on-the-fly in a self-regulating manner during operation of the loom; and to minimize or otherwise optimize the consumption of air for the desired weft insertion process.

SUMMARY OF THE INVENTION

The above objects have been achieved in a method for monitoring the proper functioning of electromagnetic air valves in pneumatic looms according to the invention, wherein a respective magnetic valve is provided for controlling the air flow to one or more relay nozzles, and the variation pattern curve of the actuation current I over time t for each operating magnetic valve comprises a characteristic feature, which is especially represented by a current dip that arises when the respective magnetic valve actually physically switches over. Further according to the invention, the relative time of the occurrence, and optionally also the magnitude, of the characteristic feature such as the current dip is monitored and compared to a reference or nominal time for the occurrence and magnitude of the characteristic feature. A valve fault signal for that particular valve or group of valves is triggered, and/or the weaving process is directly interrupted, when the characteristic feature is entirely missing from the current variation curve of the actuation current, or when the characteristic feature is time-shifted to an unacceptable extent, or when the magnitude of the characteristic feature deviates to an unacceptable extent from corresponding nominal values.

More specifically, a nominal time interval $\Delta t_1$ is specified for the interval between the beginning or initiation of the magnetic actuation signal and the expected occurrence of the characteristic feature in the current progression curve. Then the actual time interval between the beginning of a given actuation signal for the magnetic valve and the actual time at which the characteristic feature arises is measured as time $\Delta t_1'$, which is then compared to the stored nominal value $\Delta t_1$. Alternatively, a nominal current progression curve or variation pattern can be stored in a data memory, and then an actual measured current progression curve can be compared thereto. In either case, if the difference between the measured data and the stored nominal data is too great, the fault signal is triggered.

Furthermore, based on the difference between the times $\Delta t_1$ and $\Delta t_1'$, the actuation time for the respective magnetic valve can be appropriately adjusted so that the actual switching-over of the valve occurs within an allowable tolerance range around the desired or nominal time of switching-over the valve. By taking into consideration the measured time intervals $\Delta t_1'$ and the progression or variation of the pressure of the air for the air jets over time, the consumption of compressed air for the loom can be optimized. It is a further possibility that certain ones of a plurality or lot of magnetic valves can be selected for installation into a particular loom, based on the similarity of the operating characteristics (e.g. similar time delays $\Delta t_1'$) of the selected valves.

As can be seen from the preceding discussion, an important aspect of the invention is that the electrical characteristic feature, namely the current dip or fluctuation, in the actuation current progression curve for each magnetic valve is used to determine whether or not the respective magnetic valve is mechanically properly operating. In other words, evaluation of the electrical actuation signal is used to monitor the mechanical functioning of the valve. Incidentally, the electrical characteristic feature may be determined by standard signal measurement techniques and may be represented in a characteristic curve of the actuation current as a function of time in a diagram. If the characteristic feature is missing from the current progression curve, then the loom control can provide an error signal or fault signal, and/or the weaving process being carried out on the loom may be interrupted.

Moreover, by detecting the actual time of occurrence of the characteristic feature, it is also possible to determine an exactly defined point in time for the actual beginning of the air jet provided to the relay nozzles, after the time of initiating the actuation current for the magnetic valves. In other words, it is possible to measure the switch-over times or activation time delays of the magnetic valves. Thereby, it is possible to determine the tolerances in the electromechanical switching time, and to detect possibly undesirable changes or variations in the operation of the valves, which may, for example, arise due to wear over time or due to assembly or installation variations or adjustment tolerances or other deviations. Once these variations or deviations are accurately measured, it is possible to adjust and thereby correct the actuation, i.e. initiation of the electrical signal, for the valves in such a manner that the actual mechanical switching of the valves occurs at the desired point in time and thus, that the desired optimum distribution of air to the relay nozzles is achieved.

The method according to the invention also makes it possible to achieve an early detection of an imminent valve failure, because the characteristic feature, i.e. the current dip or fluctuation, in the actuation current curve over time will usually show a time shift or a magnitude variation before a total failure of the valve takes place. As another advantage of the invention, an optimization of the air distribution is achieved, which simultaneously means a minimization of the total air consumption. As an overall result, the functional reliability of the weft insertion system is improved, while maintaining optimum weft insertion parameters. Moreover, by using the characteristic feature in the actuation current curve according to the invention, it is possible to operate the loom diagnostically on-the-fly so that any weaknesses or non-optimized parameters of the loom operation can be detected in the loom control already during the early or beginning phase of a weaving process. Any necessary corrections can then be made before the rest of the weaving process is carried out.

BRIEF DESCRIPTION OF THE DRAWINGS

In order that the invention may be clearly understood, it will now be described, by way of example, with reference to the accompanying drawings, wherein.

DETAILED DESCRIPTION OF PREFERRED EXAMPLE EMBODIMENTS AND OF THE BEST MODE OF THE INVENTION

Figure 1:
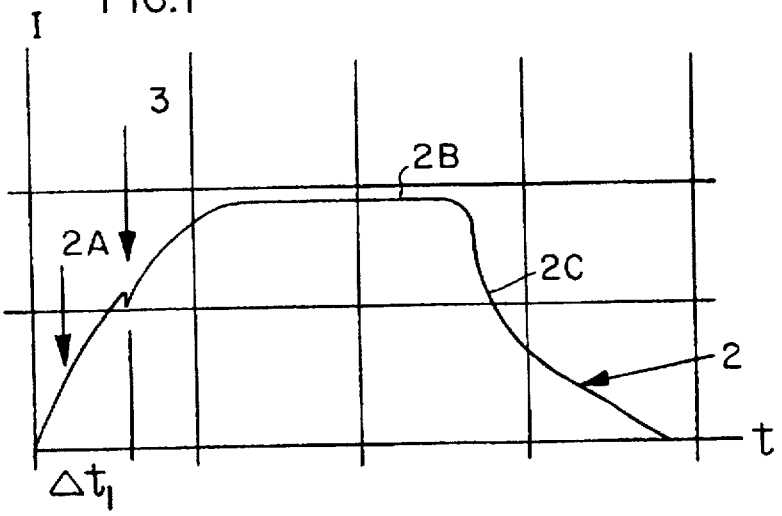
FIG. 1 is a diagram showing a characteristic progression curve of the actuation current I as a function of time t for a magnetic valve controlling the air flow to a relay nozzle in a pneumatic loom.

Electrically actuatable magnetic valves 1 are used in a pneumatic loom, especially for controlling the effective actuation period for each respective relay nozzle or for a group of relay nozzles associated with each magnetic valve in the loom. FIG. 1 shows a typical current progression curve 2 over time for the actuation current I for a particular magnetic valve 1 for controlling the air flow to a particular relay nozzle or group of relay nozzles in the loom. In FIG. 1, the actuation current I is shown on the ordinate axis or Y-axis and time t is shown on the abscissa or X-axis. The actuation current I is provided by a direct current source (e.g. VDC) connected to the magnetic valve 1. As shown in FIG. 1, when the direct current source is switched on, the current will progress along a characteristic curve over time as shown in FIG. 1, for actuating the magnetic valve 1. The characteristic curve 2 includes a rising portion 2*a* during which the current increases from zero up to the maximum or continuous current level, a plateau portion 2*b* during which the current is maintained at the maximum level for maintaining the valve 1 in the actuated state, and a decay portion 2*c* extending from the time at which the current is switched off until the current decays to zero.

The rising portion 2*a* of the current progression curve 2 exhibits a characteristic feature 3 in the form of a current dip or current fluctuation 3 within the otherwise generally smooth increase in the current. This momentary current dip 3 occurs when the magnetic circuit of the valve 1 closes, i.e. when the valve switches over from the closed state to the open state. Thus, the current dip 3 will occur when the current level (or alternatively the voltage level) has increased to the point necessary for triggering the actuation of the particular magnetic valve, which is expected to occur at a nominal time $\Delta t_1$ after the actuation current is switched on or initiated, for a properly functioning magnetic valve and valve actuation circuit.

According to the invention, the information provided by the current progression curve 2, and especially the characteristic current dip 3 in the rising portion 2*a* of the curve 2, is used as an indication for the proper mechanical functioning of the magnetic valve 1, and thereby as an indication for the proper or improper functioning of the weft insertion system of the pneumatic loom. More specifically, either the entire rising portion 2*a* of the curve 2, or the relative time of occurrence and/or the magnitude of the characteristic feature 3 thereof, is monitored in order to detect any deviation of the actual data from corresponding reference data, which may be based on nominal data input by the user or on previously measured data that has been stored in a memory.

For example, if the characteristic feature 3 is completely missing from the rising curve portion 2*a* of the current progression curve 2, this is taken as an indication that the valve is not properly mechanically functioning, i.e. has failed to mechanically switch from the valve-closed position to the valve-open position. Moreover, if the actual measured time at which the characteristic feature 3 occurs deviates to an unacceptable degree from the nominal time $\Delta t_1$ at which the characteristic feature should occur, or if the magnitude of the characteristic feature is unacceptably large or small, this would also indicate an improper functioning of the magnetic valve 1. Note that alternatively the time deviation of the occurrence of the characteristic feature could be measured relative to the previously occurring characteristic feature, i.e. in a previous actuation cycle of the magnetic valve.

Figure 2:
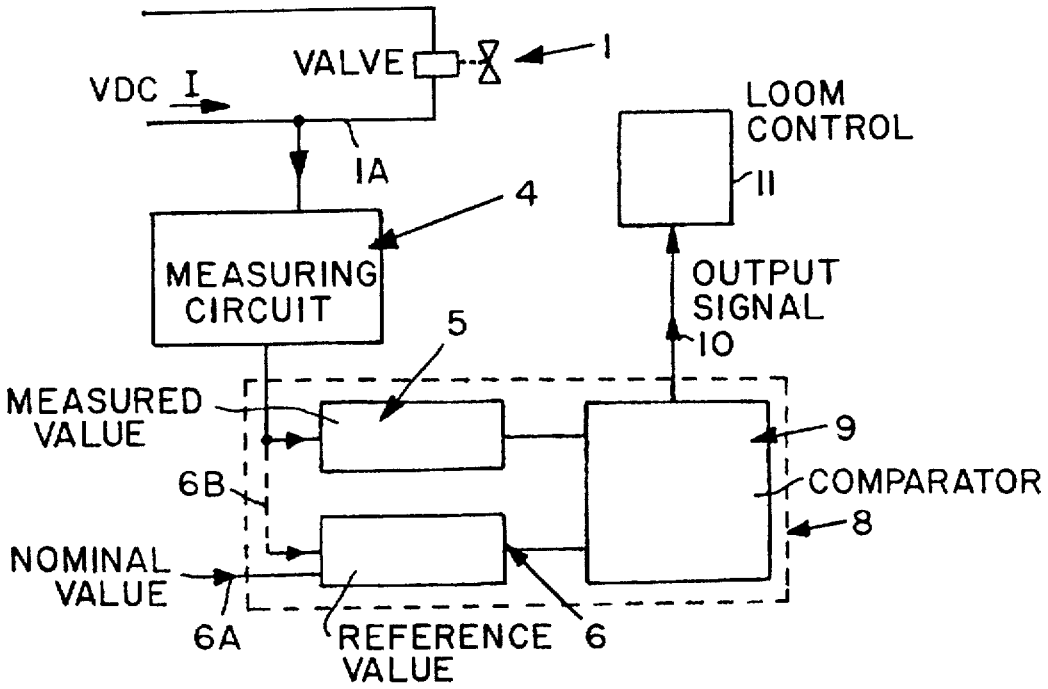
FIG. 2 is a block circuit diagram of an evaluation circuit for detecting and evaluating measured values of time intervals and/or actuation current progression curves by comparison with nominal data according to the invention.

FIG. 2 is a block diagram of a circuit that can be used according to the invention to monitor and evaluate the above discussed electrical indicators. A measuring circuit 4 monitors the progression of the current (or alternatively the voltage) of the actuation current I applied to the magnetic valve 1. The specific components and construction of the measuring circuit 4 can be carried out in several different particular ways, as would be readily apparent to a person of ordinary skill in the art. The measuring circuit 4 may, for example, include appropriate current and/or voltage measuring circuits, filters, as well as a peak value detector to monitor the current and voltage values in the actuation circuit 1*a* for the valve 1, and especially to detect and quantify the occurrence of the characteristic current dip 3 in the rising portion 2*a* of the current progression curve 2. Namely, the measuring circuit 4 may quantify the actual measured time of occurrence of the characteristic current dip 3 relative to the start time at which the current was switched on, and may quantify the magnitude of the current dip 3. Alternatively, or as a further option, the measuring circuit 4 may monitor and analyze the entire rising portion 2*a* of the curve 2. The specific components of the measuring circuit 4 may even be components or a circuit already present in the usual control circuitry for a pneumatic loom.

The measured data output of the measuring circuit 4 is then input into a data storage and evaluation circuit 8. The circuit 8 includes a temporary memory or receiver 5 for the measured value such as $\Delta t_1'$, and a memory or receiver 6 for a reference value. The input into the reference value receiver 6 is either a nominal value 6A (such as nominal time $\Delta t_1$) that is an external input by the operator of the loom, or previous measured data that was measured by the measuring circuit 4 during a prior actuation cycle of the valve 1. The data storage and evaluation circuit 8 further includes a comparator 9 connected to the outputs of the measured value receiver 5 and the reference value receiver 6. The comparator 9 compares the measured value to the reference value and provides an output signal 10, which is based on the difference between the measured value and the reference value, to the loom control 11.

As discussed above, the measured value may be an actual measured time $\Delta t_1'$ at which the characteristic current dip 3 occurs, while the reference value is a nominal value for the time of occurrence $\Delta t_1$ of the current dip 3 or a previously measured time value. Alternatively, the measured value may be or may include an actual magnitude of the current dip 3, and the reference value may be a corresponding reference magnitude of the current dip 3. As a further alternative, the measured value may be data characterizing the entire increasing portion 2*a* of the current curve 2, while the reference value may be a corresponding reference plot of the increasing portion 2*a* of the current curve 2.

If the data storage and evaluation circuit 8 detects a complete absence of the characteristic current dip 3 in the measured value, or detects a time deviation of the occurrence of the characteristic current dip 3 from the nominal or reference time, outsided of a tolerance range 7 (see FIG. 3) then the circuit 8 provides an output signal 10 that indicates a fault in the operation in the corresponding magnetic valve 1, or is used in the loom control 11 to adjust and correct the operation of the respective valve 1 or to interrupt the weaving process.

Figure 3:
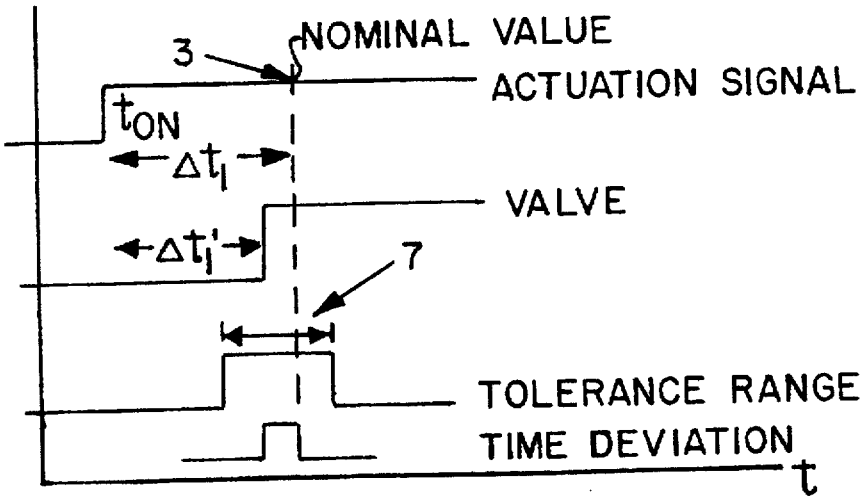
FIG. 3 is a signal timing diagram showing actual time periods in relation to the nominal time value.

FIG. 3 shows an example timing diagram in which the relative time of occurrence of the characteristic current dip 3 is used as an indicator of the proper functioning of the magnetic valve 1. The four lines or signals shown in the timing diagram of FIG. 3 are each depicted relative to the nominal time of occurrence $\Delta t_1$ of the characteristic current dip 3, which is designated as the nominal value. The top line in FIG. 3 shows the actuation signal for actuating the magnetic valve 1, wherein the nominal time between initiating or switching on the actuation signal ($t_{on}$) and the expected or nominal time of occurrence of the characteristic feature 3 in the current progression curve 2 according to FIG. 1 is designated as the nominal time value $\Delta t_1$. The second line in FIG. 3 shows the actual time $\Delta t_1'$ at which the valve is actuated, relative to the actuation initiation time ($t_{on}$). This measured actual value $\Delta t_1'$ is input into the measured value receiver 5.

If the difference between the actual measured value $\Delta t_1'$ and the nominal value $\Delta t_1$, i.e. the time deviation shown in the last line of FIG. 3, falls within the tolerance range 7 shown in the third line of FIG. 3, then the valve 1 is operating satisfactorily. On the other hand, if the time deviation between $\Delta t^{1''}$ and $\Delta t_1$ falls outside of the tolerance range 7, then the valve 1 is operating in an unsatisfactory or faulty manner. In this case, an error signal can be displayed to the loom operator, the loom can be stopped, or the operation of the faulty valve 1 can be adjusted or corrected as needed on-the-fly.

A particularized fault message can be provided as follows. The valve fault message is an advance warning of expected future valve failure when a difference exceeds a lower first threshold but does not exceed a higher second threshold. On the other hand, the valve fault message is an indication of actual present valve failure when the difference between the actual value and the reference value exceeds the second higher threshold.

If the valve operation is to be adjusted, in addition to or instead of providing a fault message, the actual time ($t_{on}$) for initiating the actuating signal for actuating the particular valve 1 is shifted in consideration of the time deviation between the reference value $\Delta t_1$ and the actual measured value $\Delta t_1'$ and in consideration of the total cycle time of the operation of the particular valve and of the weft insertion. For example, if the particular valve 1 is actually being actuated earlier than desired, then the initiation time $t_{on}$ is shifted correspondingly later, and if the valve is actually being actuated later than desired, then the initiation time $t_{on}$ is shifted correspondingly earlier.

Electrically monitoring the actual physical operation of each magnetic valve for each respective relay nozzle or group of relay nozzles according to the invention also allows the corresponding data signals to be used to optimize the consumption of compressed air by the respective relay nozzles. Namely, since the measured time values $\Delta t_1'$ indicate the actual time at which each valve opens, the actuation signal for each valve can be adjusted as needed to provide the minimum necessary jet of air at precisely the correct time and for the correct duration, further in view of monitoring the build-up of pressure in the compressed air for operating the relay nozzles. In this way, the operation or actuation of each relay nozzle or group of relay nozzles can be optimized, and the total air consumption can be reduced to the minimum level while still achieving proper weft insertion performance.

Moreover, since the invention provides a way of electrically monitoring or testing the mechanical functioning of each magnetic valve, the inventive method can be used initially for selecting particular valves to be installed in any given loom from a large lot or plurality of valves. In other words, to ensure uniform and consistent functioning of all of the valves in a pneumatic loom, the invention provides a method for selecting valves that have similar actuation delay times, so that fine-tuning the operation of all of the valves in the loom is simplified, because all of the valves operate close to the nominal or desired operating point.

Although the invention has been described with reference to specific example embodiments, it will be appreciated that it is intended to cover all modifications and equivalents within the scope of the appended claims.

What is claimed is:

1. A method for evaluating the operation of an electrically actuatable magnetic valve in an air jet loom that uses said magnetic valve to control air flow to one or more weft insertion relay nozzles, said method comprising the following steps in a valve actuation cycle during a weft insertion cycle:

(a) applying an electrical actuation current to said magnetic valve;

(b) monitoring a progression of said electrical actuation current over time for detecting an actual value of an one electrical indicator selected from the group consisting of a characteristic increasing curve of said progression, a time of occurrence of a characteristic feature within said increasing curve, and a magnitude of said characteristic feature;

(c) establishing a reference value for said electrical indicator;

(d) comparing said actual value of said electrical indicator with said reference value, and releasing a fault signal if said actual value unacceptably deviates from said reference value.

2. The method of claim 1, further comprising a step of establishing a tolerance range of an acceptable deviation of said actual value from said reference value, and wherein said step (d) comprises releasing said fault signal if a difference between said actual value and said reference value falls outside of said tolerance range.

3. The method of claim 1, wherein said reference value is an inputtable nominal value, and said step (c) comprises inputting said nominal value into a reference value memory.

4. The method of claim 1, further comprising carrying out a plurality of said valve actuation cycle in succession, wherein said reference value is a prior one of said actual value from a prior one of said plurality of said valve actuation cycle, and said step (c) comprises at least temporarily storing said prior actual value into a reference value memory.

5. The method of claim 1, wherein said electrical indicator is said characteristic increasing curve of said progression, said step (b) comprises monitoring and detecting measured data corresponding to said characteristic increasing curve as a function of time beginning at a time of initiating said electrical actuation current, and said reference value comprises reference data corresponding to a reference increasing curve as a function of time.

6. The method of claim 5, wherein said step (d) comprises determining an amount of time-shift between said measured data and said reference data, and releasing said fault signal if said amount of time-shift exceeds an acceptable tolerance range.

7. The method of claim 1, wherein said electrical indicator is one of said time of occurrence of said characteristic feature and said magnitude of said characteristic feature, and said reference value comprises one of a reference time and a reference magnitude for said characteristic feature.

8. The method of claim 7, wherein said characteristic feature comprises a momentary current dip in said increasing curve of said progression of said electrical actuation current.

9. The method of claim 7, wherein said characteristic feature comprises a momentary voltage fluctuation in said increasing curve of said progression of said electrical actuation current.

10. The method of claim 7, wherein said electrical indicator is said time of occurrence of said characteristic feature, said reference value comprises said reference time, and said step (d) comprises releasing said fault signal if said time of occurrence of said characteristic feature deviates from said reference time beyond an acceptable tolerance range.

11. The method of claim 7, wherein said electrical indicator is said magnitude of said characteristic feature, said reference value comprises said reference magnitude, and said step (d) comprises releasing said fault signal if said magnitude of said characteristic feature deviates from said reference magnitude beyond an acceptable tolerance range.

12. The method of claim 7, wherein said actual value detected in said step (b) is a nil value, and wherein said step (d) comprises releasing said fault signal.

13. The method of claim 7, wherein said characteristic feature is characteristic of and caused responsively to a physical switching-over of said magnetic valve from a valve-closed position to a valve-open position.

14. The method of claim 1, further comprising displaying a valve fault message in response to release of said fault signal.

15. The method of claim 14, wherein said valve fault message is an advance warning of expected future valve failure when a difference between said actual value and said reference value exceeds a lower first threshold and does not exceed a higher second threshold, and wherein said valve fault message is an indication of actual present valve failure when said difference exceeds said second higher threshold.

16. The method of claim 1, further comprising starting operation of said loom in a weaving operation before said step (a), and then interrupting said weaving operation of said loom in response to release of said fault signal.

17. The method of claim 1, wherein said actual value is an actual time value, said reference value is a reference time value, and said step (d) comprises determining a time deviation of said actual value from said reference value, and further comprising adjusting a time of initiating said step (a) in a subsequent valve actuation cycle during a subsequent weft insertion cycle responsive to said releasing of said fault signal and to an extent dependent upon said time deviation of said actual value from said reference value.

18. The method of claim 17, wherein said adjusting of said time of initiating said step (a) comprises time-shifting said time of initiating within said subsequent weft insertion cycle of said loom to an extent so as to reduce said time deviation of said actual value from said reference value in said subsequent valve actuation cycle.

19. The method of claim 1, wherein said actual value is an actual time value, said reference value is a reference time value, and said step (d) comprises determining a time deviation of said actual value from said reference value, and further comprising providing pressurized air to said valve and monitoring a pressure of said pressurized air during said valve actuation cycle, and adjusting a time of initiating said step (a) in a subsequent valve actuation cycle responsive to and dependent upon said time deviation and said monitored pressure so as to reduce a total consumption of said pressurized air.

20. The method of claim 1, wherein said loom comprises a first plurality of said magnetic valve, and further comprising a preliminary sequence of steps including providing a second plurality of said magnetic valve greater in number than said first plurality, carrying out said steps (a) to (d) to evaluate the operation of each magnetic valve of said second plurality of valves, then selecting said first plurality of valves among said second plurality of valves based on said actual value detected for each said valve in said second plurality, and then installing said first plurality of valves in said loom.

* * * * *